US006857382B2

(12) United States Patent
Perkins

(10) Patent No.: US 6,857,382 B2
(45) Date of Patent: Feb. 22, 2005

(54) MAGNETIC DOCKING APPARATUS AND METHOD FOR USING THE SAME

(75) Inventor: William Perkins, Houston, TX (US)

(73) Assignee: Small Ventures USA, L.L.C., Houston, TX (US)

( * ) Notice: Subject to any disclaimer, the term of this patent is extended or adjusted under 35 U.S.C. 154(b) by 0 days.

(21) Appl. No.: 10/653,555

(22) Filed: Sep. 2, 2003

(65) Prior Publication Data

US 2004/0051309 A1 Mar. 18, 2004

Related U.S. Application Data

(60) Provisional application No. 60/407,873, filed on Aug. 30, 2002.

(51) Int. Cl.[7] ..... B63B 21/00
(52) U.S. Cl. ..... 114/230.1
(58) Field of Search ..... 114/230.1, 230.26

(56) References Cited

FOREIGN PATENT DOCUMENTS

JP 59217819 A * 12/1984 ..... E02B/3/20
JP 02018192 A * 1/1990 ..... B63B/21/22

* cited by examiner

*Primary Examiner*—Jesus D. Sotelo
(74) *Attorney, Agent, or Firm*—Vinson & Elkins L.L.P.

(57) ABSTRACT

A magnetic docking apparatus includes a support member having an electromagnet attached thereto. The support member includes a fastener for attaching the magnetic docking apparatus to a vessel. The support member and the fastener cooperate to position the electromagnet external to the vessel. When the vessel is positioned proximate a docking point that includes a ferrous object, the magnetic docking apparatus is operable to energize the electromagnet. When energized the electromagnet creates a magnetic attraction between itself and the ferrous object, and the magnetic attraction causes the vessel to be held at the docking point. The electromagnet is also operable to be de-energized to release the vessel from the docking point. In another aspect of the present invention, a method includes attaching a magnetic docking apparatus to a vessel. The magnetic docking apparatus includes a support member having an electromagnet attached thereto. The vessel is positioned proximate a docking point that includes a ferrous object. The electromagnet is energized to create a magnetic attraction between itself and the ferrous object. The magnetic attraction causes the vessel to be held at the docking point. The electromagnet is de-energized to release the vessel from the docking point.

31 Claims, 4 Drawing Sheets

MAGNETIC DOCKING APPARATUS AND METHOD FOR USING THE SAME

REFERENCE TO EARLIER FILED APPLICATION

This application claims the benefit of U.S. Provisional Application No. 60/407,873, filed Aug. 30, 2002.

BACKGROUND OF THE INVENTION

1. Field of the Invention

This invention relates generally to using a magnet to attach a vessel to another object, and, more particularly, to using a magnet to attach a vessel, such as a vehicle, to another vessel or docking point.

2. Description of the Related Art

Many water-based vessels, such as ferries, tugs, and cargo ships use thrust generated by on-board motors to keep the vessel in position when docking with land, against other vessels, or other docking points. For example, a passenger ship may maneuver through a harbor or channel using its own propulsion system or with the assistance of a tugboat or other positioning vessel. The ship may be guided toward a docking point, such as a pier, dock, or other structure, that has been equipped with protective padding, such as tires, inflatable bladders, and the like, to prevent the docking point from damaging the hull of the ship. The ship may be positioned so that at least some portion of its hull is proximate the docking point. For example, in one embodiment, one side of the ship may be positioned against a dock so that the surface area of the hull to be mated with the dock is maximized.

Once the ship is sufficiently near the docking point, on-board motors may be used to generate thrust that holds the ship against the docking point. The thrust from the on-board motors may be used to hold the ship in place, while passengers are boarded and/or cargo is loaded. Often, the ship is docked for an extended period requiring the constant use of thrust to keep the ship positioned in the desired space.

In some situations, the thrust from one or more tugboats or other positioning vessels is used to keep a larger vessel in position when docked. For example, one or more tugboats may be positioned on one side of the docked ship, while the other side of the ship is mated with a docking point. By applying thrust to the opposite side of the ship, one or more tugboats may be used to hold the ship in its docked position. Usually, the tugboat is equipped with a protective barrier (e.g., tires, inflatable bladders, etc.) around its hull to prevent damages to either ship.

These techniques for keeping a vessel secure to a docking point, while somewhat effective, are not energy efficient. A more efficient method of keeping a vessel in position while docked may be accomplished using various configurations of electromagnets. Such electromagnets may be used to keep a vessel secure to a docking point, and if properly configured, may allow for a range of movement in certain directions to accommodate the action of waves, or other motion.

The present invention is directed to overcoming, or at least reducing the effects of, one or more of the problems set forth above.

SUMMARY OF THE INVENTION

A magnetic docking apparatus includes a support member having an electromagnet attached thereto. The support member includes a fastener for attaching the magnetic docking apparatus to a vessel. The support member and the fastener cooperate to position the electromagnet external to the vessel. When the vessel is positioned proximate a docking point that includes a ferrous object, the magnetic docking apparatus is operable to energize the electromagnet. When energized, the electromagnet creates a magnetic attraction between itself and the ferrous object, and the magnetic attraction causes the vessel to be held at the docking point. The electromagnet is also operable to be de-energized to release the vessel from the docking point.

In another aspect of the present invention, a method for magnetically docking a vessel to another object is provided. The method includes attaching a magnetic docking apparatus to a vessel. The magnetic docking apparatus includes a support member having an electromagnet attached thereto. The vessel is positioned proximate a docking point that includes a ferrous object. The electromagnet is energized to create a magnetic attraction between itself and the ferrous object. The magnetic attraction causes the vessel to be held at the docking point. The electromagnet is de-energized to release the vessel from the docking point.

BRIEF DESCRIPTION OF THE DRAWINGS

The invention may be best understood by reference to the following description taken in conjunction with the accompanying drawings, in which like reference numerals identify like elements, and in which.

Figure 1A:
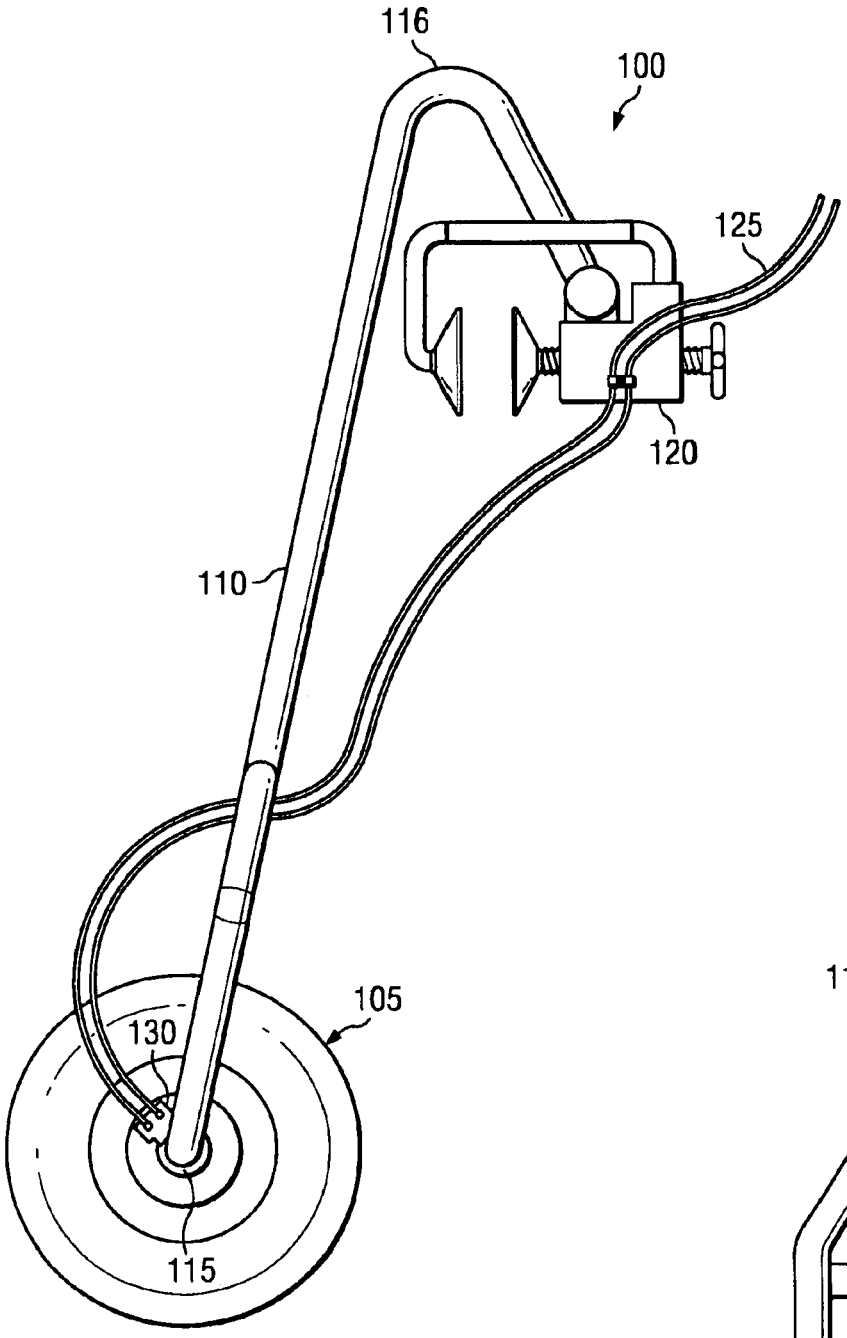
FIG. 1A illustrates an electromagnetic docking mechanism in accordance with one embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring to FIG. 1A, a docking mechanism 100 in accordance with one embodiment of the president invention is shown. The docking mechanism 100 includes an electromagnet 105 attached to a support member 110 at a hub 115. In this configuration, the electromagnet 105 is free to rotate about the hub 115. It should be appreciated, however, that FIG. 1A is not to scale in order to emphasize certain portions of the present invention.

The support member 110 may be constructed in a number of configurations using any number of different materials. Moreover, the particular details of the support member 110, such as shape, dimensions, composition, and the like may vary to suit a particular application or simply as a matter of design choice. In this example, the support member 110 is comprised of tubular steel and is constructed to include a bow 116 that peaks above a clamp 120. As will be described below, when shaped in this configuration, the support member 110 may be more easily positioned over one side of a vessel, such as a ship, so that the electromagnet 105 is situated to mate with or come within close proximity to a ferrous object, such as a ferrous plate, attached to a docking point.

The clamp 120 is attached to the support member 110 and is operable to secure the docking mechanism 100 to a vessel. As described for the support member 110, the particular details of the clamp 120 may vary depending upon the application or use of the present invention. It should be understood that the clamp 120 is but one of an infinite number of mechanisms that can be used to secure the docking mechanism 100 to a vessel. For example, the docking mechanism 100 could be attached to a vessel using bolts, rivets, welds, or any other type of fastener. In short, the manner in which the docking mechanism 100 is attached to a vessel is not material to the present invention.

In another embodiment, the support member 110 may include a telescoping or adjustable piece (not shown) that allows the distance between the clamp 120 and the electromagnet 105 to be decreased, increased, or otherwise adjusted as desired. This may be accomplished, for example, using hydraulic supports or other types of adjustable pieces. As will be explained below, the electromagnet 105 of the docking mechanism 100 may be mated with or come within close proximity to a ferrous object to hold a vessel, such as a vehicle, ship, or other type of craft, at a docking point. If the docking mechanism 100 is configured with an adjustable support member, the position of the electromagnet 105 may be adjusted to more easily mate with or be positioned within close proximity to a ferrous object.

Power is supplied to the electromagnet 105 by a cable 125 using brushes 130. The brushes 130 allow power to be delivered to the electromagnet 105 even when the electromagnet 105 is rotating. The particular details of the cable 125 and the brushes 130, such as shape, composition, position, and the like, may vary to suit a particular application or simply as a matter of design choice. Moreover, any other technique may be used to deliver power sufficient to energize the electromagnet 105.

Figure 1B:
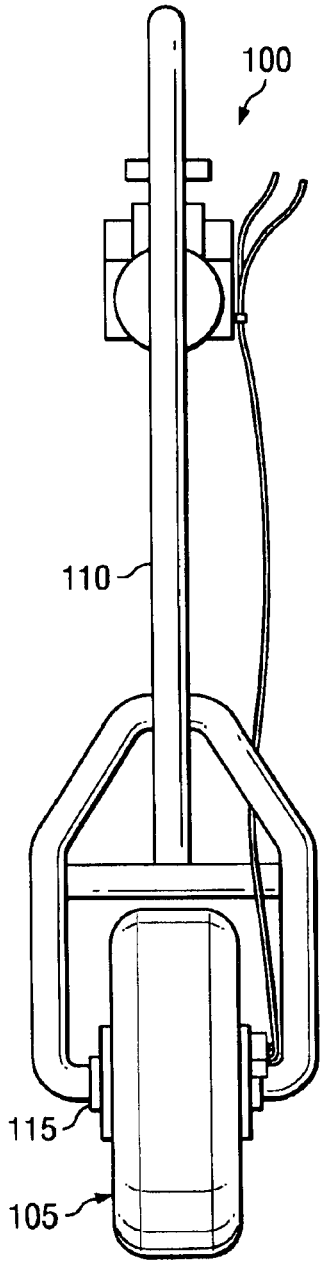
FIG. 1B illustrates a side view of the docking mechanism shown in FIG. 1A.

Referring to FIG. 1B, a side view of the docking mechanism 100 is shown. Continuing with this illustrative example, the support member 110 is configured to provide structural integrity for supporting the electromagnet 105, while permitting the electromagnet 105 to rotate about the hub 115. In this example, the electromagnet 105 is shaped as a toroid with the hub 115 passing through its center. It should be appreciated, however, that any number of electromagnet shapes and configurations may be used with the present invention. Moreover, other details of the docking mechanism 100, such as shape, dimensions, composition, and configuration may vary to suit a particular application or as a matter of design choice.

Figure 2:
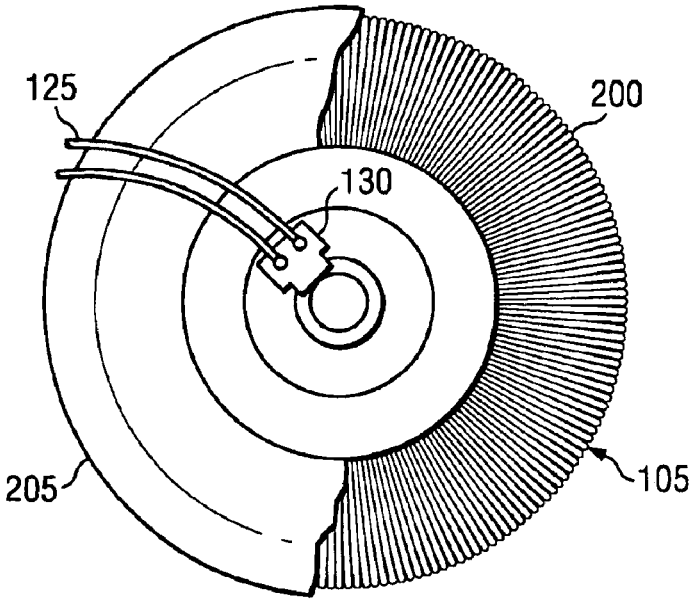
FIG. 2 is a cut-away view of a portion of the illustrative docking mechanism shown in FIGS. 1A and 1B.

Referring to FIG. 2, a cut-away view of the electromagnet 105 is shown. In this example, the cut-away view illustrates the electromagnet 105 to include a core wrapped with wire 200, as is well known in the art. The core and the wire 200 may be comprised of any number of known materials used for constructing electromagnets. In one illustrative embodiment, the core may be comprised of iron, while the wire 200 is comprised of copper.

A rubber coating 205 may be used to cover and protect the wire 200. The rubber coating 205 may serve to protect the wire 200 and the core from the corrosive effects of salt water and other environmental conditions. The rubber coating 205 may also protect the wire 200 and the core when the electromagnet 105 is in contact with a ferrous object. Moreover, the rubber coating 205 insulates the wire 200 from its surroundings. The rubber coating 205 may be comprised of any number of known materials and may be applied using any number of known techniques, such as dipping, spraying, and the like.

Figure 3:
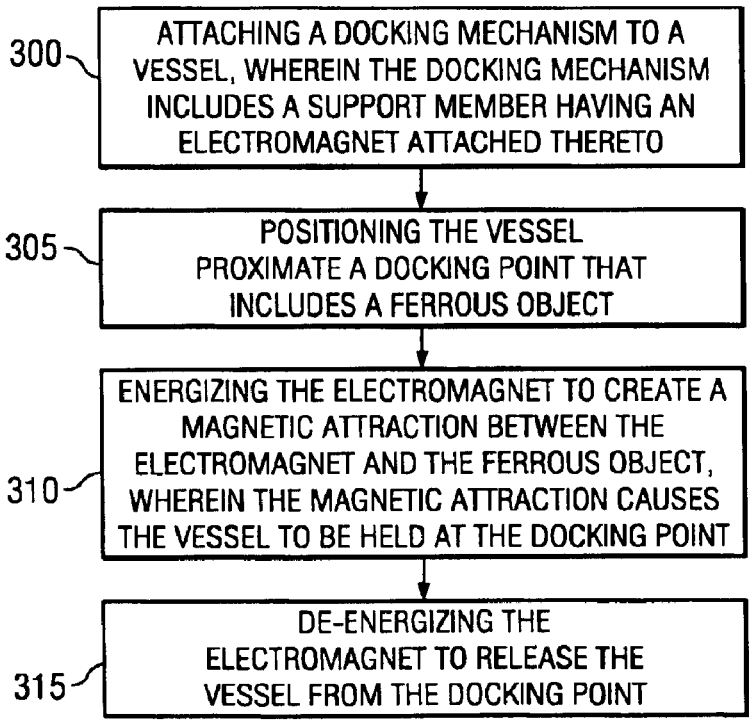
FIG. 3 is a simplified block diagram illustrating one exemplary process for a magnetic docking mechanism in accordance with one aspect of the present invention.

Referring the FIG. 3, a method for magnetically docking a vessel to another object is shown. This process is discussed with reference to the docking mechanism 100 illustrated in FIGS. 1A and 1B to simplify the discussion of the present invention and not for the purpose of limitation. The process is also discussed with reference to FIG. 4, which is just one illustrative application of the present invention.

Figure 4:
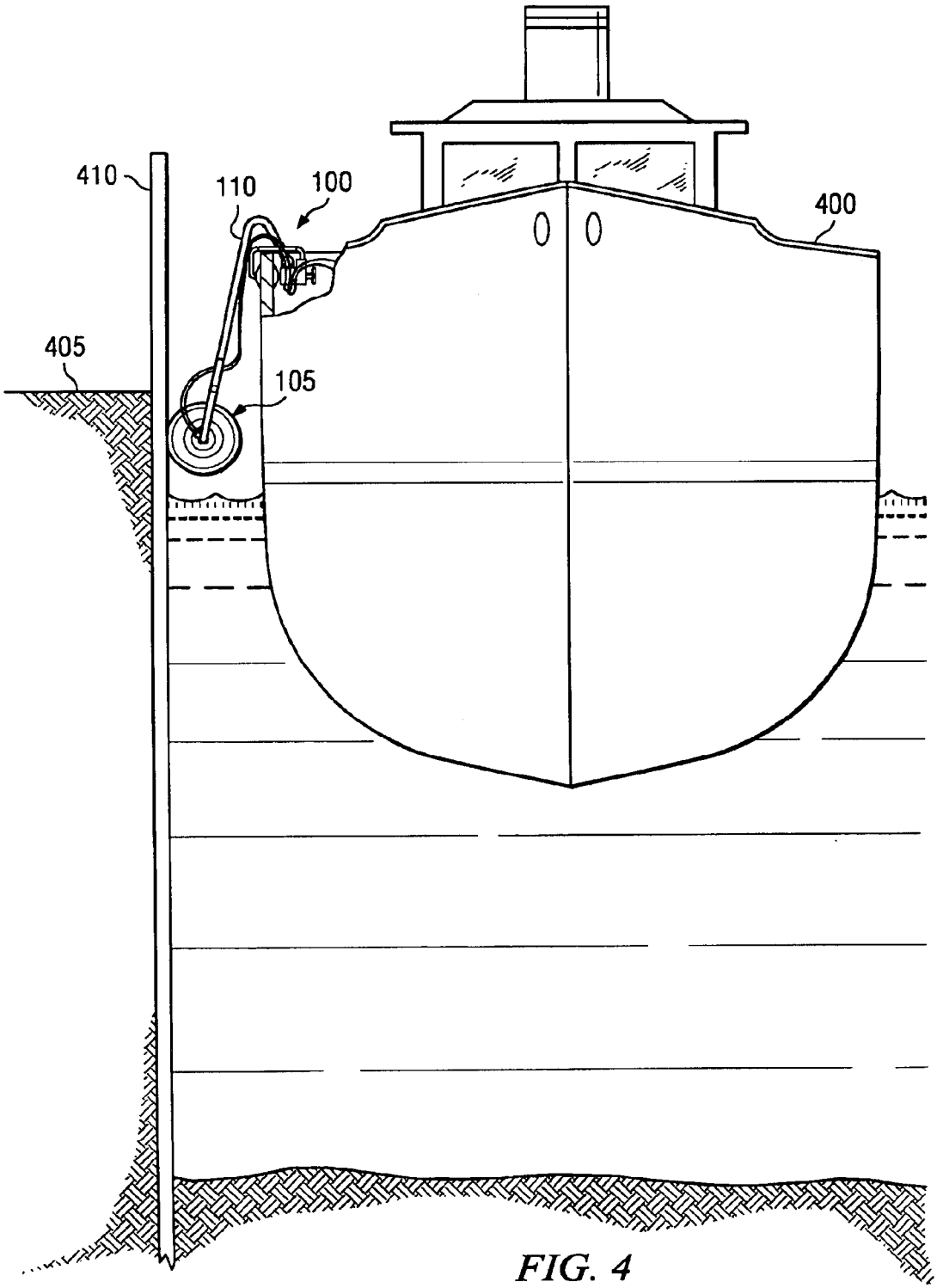
FIG. 4 is a simplified drawing illustrating one exemplary application of the process shown in FIG. 3.

In FIG. 4, the docking mechanism 100 is illustrated attached to a ship 400. The ship 400 is shown positioned proximate a docking point 405 (e.g., pier, dock, unloading station, stopping point, a second vessel, etc.) A ferrous object 410 is attached to the dock 405. In this example, the ferrous object 410 is an iron plate.

It should be appreciated that the configuration of the docking mechanism 100, shown in FIGS. 1A and 1B, is just one of many possible solutions that may be used to implement the method of FIG. 3. Likewise, the exemplary application of the present invention illustrated in FIG. 4 is just but one of many applications that may be used with the present invention. As described above, the exact details of the docking mechanism 100 and its application may vary as a matter of design choice.

Referring to block 300, of FIG. 3, a docking mechanism is attached to a vessel and includes a support member having an electromagnet attached thereto. In FIG. 4, the vessel is the ship 400. It should be appreciated, however, that the vessel could be any number of vehicles, such as a barge, ship, car, spacecraft, etc. In this example, the support member 110 attaches the docking mechanism 100 to the ship 400. Furthermore, although not shown, a plurality of docking mechanisms may be attached to the vessel. The exact number of docking mechanism used may vary depending upon the particular application.

At block 305, the vessel is positioned proximate a docking point that includes a ferrous object. In FIG. 4, the docking point 405 is an actual dock intended for ships, however, the docking point 405 may be any structure, vessel, or object suitable for holding a vessel.

The ferrous object 410, in this example, is an iron plate. However, the ferrous object may be configured in any number of shapes and compositions. In this example, the iron plate extends laterally down at least some portion of the dock 405 to simplify horizontally mating the electromagnet 105 with the iron plate 410. Likewise, the iron plate 410 may be configured with a height dimension that is greater than the diameter of the electromagnet 105. This difference in dimension works to alleviate any vertical mating problems created by changing water depths caused by tides and wave action.

In another illustrative embodiment, the ferrous object may be hingedly or pivotally attached to the docking point. When pivotally attached, the ferrous object is free to move in either direction about the pivot point. The movement of the ferrous object about its pivot point or hinge may be restricted, if desired, using a number of different energy suppressers, such as struts, springs, hydraulics, and the like.

As an example, referring to FIG. 4, the ferrous plate 410 may be pivotally attached to the dock 405, so that it is free to sway back and forth to and from the ship. To restrict its motion, a plurality of dampeners may be attached to the ferrous plate 410 and the dock 405. If appropriately arranged, the dampeners serve to restrict and resist the movement of the ferrous plate in either direction. The movement of the plate 410, along with the resistance of the dampeners, is operable to absorb impact energy from the electromagnet 105 mating with the ferrous plate 410 and the continual energy transfer from wave action.

At block 310, the electromagnet is energized to create a magnetic attraction between the electromagnet and the ferrous object. The magnetic attraction is operable to hold the vessel at the docking point. In FIG. 1, the cable 125 transfers energy to the electromagnet 105, thereby creating a magnetic field in the vicinity of the electromagnet 105. When the electromagnet is close enough to the ferrous object, the electromagnet is drawn to the ferrous object. The electromagnet tends to keep the docking mechanism and the vessel it is attached near the ferrous object.

In FIG. 4, when the electromagnet 105 of the docking mechanism 100 is energized the electromagnet 105 and the ship 400 to which it is attached is drawn to the iron plate 410. The electromagnet attraction tends to hold the ship 400 near the iron plate 410. In this example, since the electromagnet 105 is in the shape of a wheel, however, the ship 400 can move up and down to accommodate wave action, while lateral movement parallel with the dock 405 is substantially suppressed.

Generally, however, it should be appreciated that the electromagnet need not mate with the ferrous object to hold a vessel in place. For example, bumpers and other objects may be used to prevent mating but still allow magnetism to hold the vessel in a docked position. The particular arrangement or application of the present invention may vary as a matter of design choice.

At block 315, the electromagnet is de-energized, and the vessel is released from the docking point. The electromagnet may be de-energized by no longer providing it with power. In FIG. 4, when the electromagnet 105 is de-energized, the ship 400 becomes free to maneuver.

In another example, the docking mechanism may be attached to a docking point rather than a vessel. In this embodiment, the ferrous object would be attached to the vessel. The illustrative examples previously discussed would work substantially the same except that the locations of the docking mechanism and the ferrous object are reversed. In yet another embodiment, the vessel and the docking point may each include both the docking mechanism and the ferrous object. As described above, the location, configuration, and application of the docking mechanism may vary as a matter of design choice.

Figure 5:
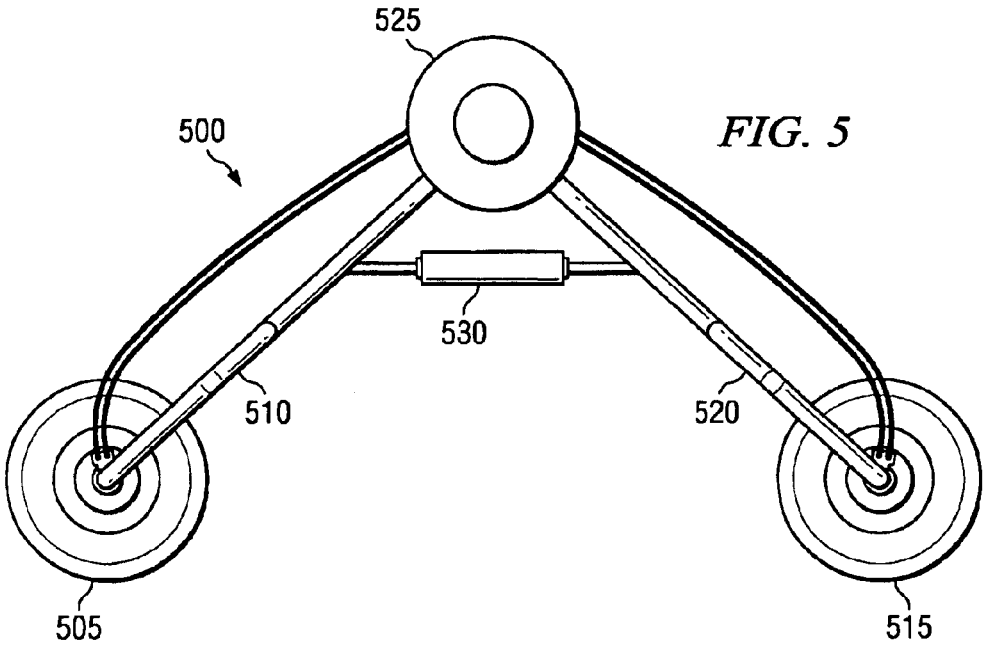
FIG. 5 is an electromagnetic docking mechanism in accordance with another embodiment of the present invention.

Referring to FIG. 5, a docking mechanism 500 in accordance with another embodiment of the present invention is shown. In this embodiment, a first rotatable magnet 505 is attached to a first support member 510 at a first hub (not shown). A second rotatable magnet 515 is attached to a second support member 520 at a second hub (not shown). The support members 510, 520 are connected by a pivot point 525. Like the electromagnet 100, illustrated in FIG. 1, the electromagnets 505, 515 can rotate about the first and second hubs and can be energized to create magnetic fields in their vicinity.

The first and second support members 510, 520 may be biased in a set position using a dampener 530, such as a spring, strut, or other energy suppresser. In this configuration, the movement of the first and second support members 510, 520 about the pivot point 525 is allowed but resisted by the dampener 530. The allowance of such limited movement can be advantageous in certain circumstances, such as to accommodate wave action.

The particular embodiment, shown in FIG. 5, contemplates each electromagnet 505, 515 mating with a ferrous object but is not required. This could be done, for example, with two separate ferrous objects or by one large ferrous object. In another embodiment, one of the electromagnets 505, 515 can be removed and that support member 510, 520 can be permanently or removably attached to a vessel or other object using, for example, a clamp.

Figure 6:
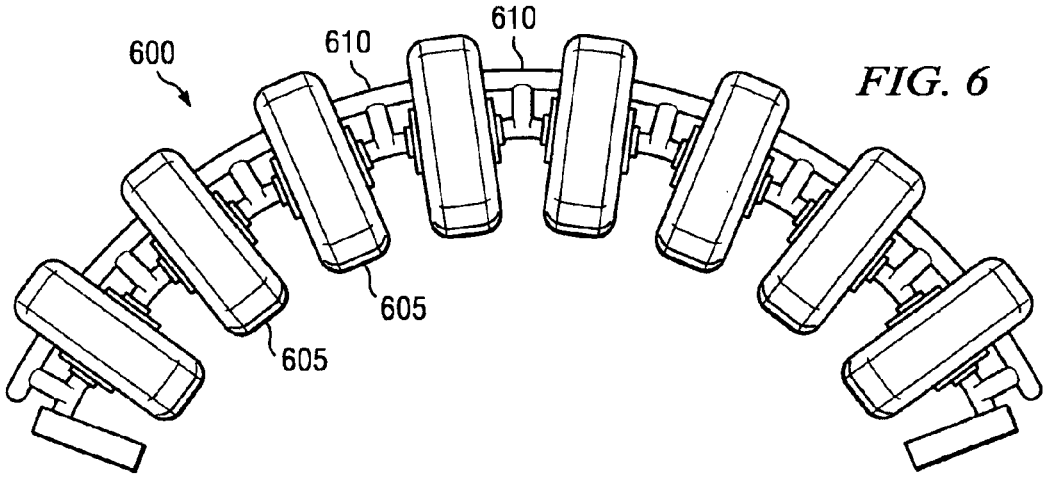
FIG. 6 is an electromagnetic docking mechanism in accordance with yet another embodiment of the present invention.

Referring to FIG. 6, a docking mechanism 600 in accordance with yet another embodiment of the present invention is shown. In this embodiment, a plurality of electromagnets 605 are attached to a bow shaped support member 610. As with the previously described embodiments, the electromagnets 605 are rotatably connected to the support member 610. When energized, the electromagnets 605 tend to draw whatever vessel or object the electromagnets are attached to toward a ferrous object. The docking mechanism 600 may be placed on the side of a ship, for example, to accommodate docking with other ships or other ferrous objects.

It should be appreciated that the docking mechanisms 100, 500, 600 described above may be used for a variety of different applications. The example illustrated in FIG. 4 is intended to illustrate but just one of many different possibilities. For example, the docking mechanisms 100, 500, 600 could be used in space to allow one spacecraft to dock with another.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A magnetic docking apparatus, comprising:

a support member having an electromagnet attached thereto, the support member including a fastener for attaching the magnetic docking apparatus to a vessel, wherein the support member and the fastener are cooperatively operable to position the electromagnet external to the vessel, and when the vessel is positioned proximate a docking point that includes a ferrous object, the magnetic docking apparatus is operable to:

energize the electromagnet to create a magnetic attraction between the electromagnet and the ferrous object, wherein the magnetic attraction causes the vessel to be held at the docking point; and de-energize the electromagnet to release the vessel from the docking point.

2. The magnetic docking apparatus of claim 1, wherein the support member is adjustably operable so that the position of the electromagnet with respect to the fastener is adjustable.

3. The magnetic docking apparatus of claim 1, wherein the electromagnetic is substantially round and is rotatably connected to the support member.

4. The magnetic docking apparatus of claim 1, wherein the electromagnet is coated with a rubber coating.

5. The magnetic docking apparatus of claim 1, wherein the support member is shaped with a bow that peaks above the fastener.

6. The magnetic docking apparatus of claim 1, further comprising a second support member, wherein the first and second support members are pivotally connected at a pivot point and biased in a set position by a dampener, wherein the dampener allows resisted movement of the first and second support members about the pivot point.

7. The magnetic docking apparatus of claim 6, further comprising a second electromagnet attached to the second support member.

8. A method for magnetically docking a vessel to another object, comprising:

attaching a magnetic docking apparatus to a vessel, wherein the magnetic docking apparatus includes a support member having a fastener and an electromagnet attached thereto, and the magnetic docking apparatus is adjustably operable so that the position of the electromagnet with respect to the fastener is adjustable;

positioning the vessel proximate a docking point that includes a ferrous object;

energizing the electromagnet to create a magnetic attraction between the electromagnet and the ferrous object, wherein the magnetic attraction causes the vessel to be held at the docking point; and de-energizing the electromagnet to release the vessel from the docking point.

9. The method of claim 8, wherein position the vessel proximate a docking point that includes a ferrous object includes positioning the vessel proximate a ferrous object that is pivotally attached to the docking point using at least one dampener, and, when docking the vessel, the at least one dampener is operable to absorb energy transferred to the ferrous object by the vessel.

10. The method of claim 8, wherein positioning the vessel proximate a docking point that includes a ferrous object comprises positioning the vessel proximate a second vessel.

11. The method of claim 10, wherein the ferrous object is attached to the second vessel and energizing the electromagnet to create a magnetic attraction between the electromagnet and the ferrous object comprises energizing the electromagnet to dock the vessel with the second vessel.

12. A system for magnetically docking a vessel at a docking point, comprising:

a ferrous object; and a magnetic docking apparatus, comprising:

a support member having an electromagnet attached thereto, the support member including a fastener for attaching the magnetic docking apparatus to the vessel, wherein the support member and the fastener are cooperatively operable to position the electromagnet external to the vessel, and when the vessel is positioned proximate the docking point that includes the ferrous object, the magnetic docking apparatus is operable to:

energizing the electromagnet to create a magnetic attraction between the electromagnet and the ferrous object, wherein the magnetic attraction causes the vessel to be held at the docking point; and de-energizing the electromagnet to release the vessel from the docking point.

13. The system of claim 12, wherein the ferrous object is an iron plate.

14. The magnetic docking apparatus of claim 12, wherein the support member is adjustably operable so that the position of the electromagnet with respect to the fastener is adjustable.

15. The magnetic docking apparatus of claim 12, wherein the electromagnet is substantially round and is rotatably connected to the support member.

16. The magnetic docking apparatus of claim 12, wherein the electromagnet is coated with a rubber coating.

17. The magnetic docking apparatus of claim 12, wherein the support member is shaped with a bow that peaks above the fastener.

18. The magnetic docking apparatus of claim 12, further comprising a second support member, wherein the first and second support members are pivotally connected at a pivot point and biased in a set position by a dampener, wherein the dampener allows resisted movement of the first and second support members about the pivot point.

19. The magnetic docking apparatus of claim 18, further comprising a second electromagnet attached to the second support member.

20. A method for magnetically docking a vessel to another object, comprising:

attaching a magnetic docking apparatus to vessel, wherein the magnetic docking apparatus includes a support member having an electromagnet attached thereto;

positioning the vessel proximate a second vessel that includes a ferrous object;

energizing the electromagnet to create a magnetic attraction between the electromagnet and the ferrous object, wherein the magnetic attraction causes the vessel to be held proximate the second vessel; and de-energizing the electromagnet to release the vessel from the second vessel.

21. The method of claim 20, wherein positioning the vessel proximate the second vessel includes positioning the vessel proximate a ferrous object that is pivotally attached to the second vessel using at least one dampener, and, when docking the vessel, the at least one dampener is operable to absorb energy transferred to the ferrous object by the vessel.

22. The method of claim 20, wherein the support member includes a fastener and attaching the magnetic docking apparatus to the vessel comprises, adjustably attaching the magnetic docking apparatus to the vessel so that the position of the electromagnet with respect to the fastener is adjustable.

23. The method of claim 20, wherein the ferrous object is attached to the second vessel and energizing the electromagnet to create a magnetic attraction between the electromagnet and the ferrous object comprises energizing the electromagnet to dock the vessel with the second vessel.

24. A method for magnetically docking a vessel to another object, comprises:

positioning a vessel that includes a magnetic docking apparatus proximate a docking point that includes a ferrous object, wherein the magnetic docking apparatus includes a support member having a fastener and an electromagnet attached thereto, and the magnetic docking apparatus is adjustably operable so that the position of the electromagnet with respect to the fastener is adjustable;

energizing the electromagnet to create a magnetic attraction between the electromagnet and the ferrous object, wherein the magnetic attraction causes the vessel to be held at the docking point; and de-energizing the electromagnet to release the vessel from the docking point.

25. The method of claim 24, wherein positioning the vessel proximate a docking point that includes a ferrous object includes positioning the vessel proximate a ferrous object that is pivotally attached to the docking point using at least one dampener, and, when docking the vessel, the at least one dampener is operable to absorb energy transferred to the ferrous object by the vessel.

26. The method of claim 24, wherein positioning the vessel proximate a docking point that includes a ferrous object comprises positioning the vessel proximate a second vessel.

27. The method of claim 26, wherein the ferrous object is attached to the second vessel and energizing the electromagnet to create a magnetic attraction between the electromagnet and the ferrous object comprises energizing the electromagnet to dock the vessel with the second vessel.

28. A method for magnetically docking a vessel to another object, comprises:

positioning a vessel that includes a magnetic docking apparatus proximate a second vessel that includes a ferrous object, wherein the magnetic docking apparatus includes a support member having an electromagnet attached thereto;

energizing the electromagnet to create a magnetic attraction between the electromagnet and the ferrous object, wherein the magnetic attraction causes the vessel to be held proximate the second vessel; and de-energizing the electromagnet to release the vessel from the second vessel.

29. The method of claim 28, wherein positioning the vessel proximate the second vessel includes positioning the vessel proximate a ferrous object that is pivotally attached to the second vessel using at least one dampener, and, when docking the vessel, the at least one dampener is operable to absorb energy transferred to the ferrous object by the vessel.

30. The method of claim 28, wherein the support member includes a fastener and, when positioning the vessel proximate the second vessel, the magnetic docking apparatus is adjustably operable so that the position of the electromagnet with respect to the fastener is adjustable.

31. The method of claim 28, wherein the ferrous object is attached to the second vessel and energizing the electromagnet to create a magnetic attraction between the electromagnet and the ferrous object comprises energizing the electromagnet to dock the vessel with the second vessel.

* * * * *